US008279159B2

(12) United States Patent
Huang

(10) Patent No.: US 8,279,159 B2
(45) Date of Patent: Oct. 2, 2012

(54) LIQUID CRYSTAL BACKLIGHT DEVICE AND METHOD FOR CONTROLLING THE SAME

(75) Inventor: Jih-Fon Huang, Chu Pei (TW)

(73) Assignee: China Star Optoelectronics International (HK) Limited, Tsuen Wan, N. T., Hong Kong (CN)

( * ) Notice: Subject to any disclaimer, the term of this patent is extended or adjusted under 35 U.S.C. 154(b) by 922 days.

(21) Appl. No.: 11/299,618

(22) Filed: Dec. 13, 2005

(65) Prior Publication Data

US 2007/0057900 A1 Mar. 15, 2007

(30) Foreign Application Priority Data

Sep. 9, 2005 (TW) ..... 94131105 A

(51) Int. Cl.
*G09G 3/36* (2006.01)

(52) U.S. Cl. ..... 345/102

(58) Field of Classification Search ..... 345/87, 345/102, 204; 349/68
See application file for complete search history.

(56) References Cited

U.S. PATENT DOCUMENTS 4,958,915 A 9/1990 Okada et al.
5,815,228 A * 9/1998 Flynn ..... 349/71
6,583,579 B2 * 6/2003 Tsumura ..... 315/169.3
6,693,619 B1 2/2004 Miura et al.
6,803,901 B1 * 10/2004 Numao ..... 345/102
7,113,163 B2 * 9/2006 Nitta et al. ..... 345/102
2002/0057238 A1 * 5/2002 Nitta et al. ..... 345/87
2003/0020677 A1 * 1/2003 Nakano ..... 345/87
2004/0012556 A1 * 1/2004 Yong et al. ..... 345/102
2004/0145560 A1 * 7/2004 Kim ..... 345/102
2004/0263095 A1 12/2004 Min et al.
2005/0099604 A1 5/2005 Mizumaki et al.
2005/0162584 A1 * 7/2005 Yamamoto et al. ..... 349/68

FOREIGN PATENT DOCUMENTS

TW I220152 8/2004
TW I231393 4/2005

* cited by examiner

*Primary Examiner* — Quan-Zhen Wang
*Assistant Examiner* — Tony Davis
(74) *Attorney, Agent, or Firm* — Cheng-Ju Chiang

(57) ABSTRACT

A liquid crystal backlight device and a method for controlling the same are applied to a liquid crystal display apparatus, in which a backlight module is disposed behind a liquid crystal panel to illuminate the panel. The backlight device produces stable illumination to solve the hold type problem due to the hold-type effect of liquid crystal occurred in the prior art. The control method is used to acquire a stable display time from the liquid crystal characteristics and then process the scan signal to match the display data. Controls of the backlight activation signal, including on/off, time delay, and duty cycle adjustment, are then performed to generate a pulse-width modulated signal and a brightness modulated signal so as to produce stable backlight illumination effect. A better display effect can therefore be accomplished.

10 Claims, 15 Drawing Sheets

LIQUID CRYSTAL BACKLIGHT DEVICE AND METHOD FOR CONTROLLING THE SAME

BACKGROUND OF THE INVENTION

1. Field of the Invention

The present invention relates to a liquid crystal backlight device and a method for controlling the same and, more particularly, to a liquid crystal backlight device, which generates a modulated backlight activation signal to control the backlight illumination patterns, and makes use of stable illumination to improve the display quality.

2. Description of Related Art

A conventional liquid crystal display apparatus comprises a liquid crystal panel and a backlight module. The liquid crystal panel comprises a plurality of scan lines, a plurality of data lines, and a plurality of pixel elements. The backlight module is disposed behind the liquid crystal panel to illuminate the liquid crystal panel. The backlight module dominates the luminous quality of the liquid crystal panel. In the prior art, when scan signals are generated in turn on the scan lines, the data write cycle is not synchronous with the backlight illumination frequency. Because the response speed of liquid crystal is slower, a hold-type effect is generated to cause the hold type problem.

In order to solve the problem of flickering frame due to the asynchronous phenomenon between the backlight illumination frequency and the data write cycle, a liquid crystal apparatus having light quantity of the backlight in synchronism with writing signals has been proposed in U.S. Pat. No. 4,958,915, in which the backlight illumination frequency is adjusted to be in synchronism with writing signals. FIGS. 1A to 1C are clock diagrams showing the relationship between the backlight illumination frequency and the scan signal of a liquid crystal panel in the prior art. In FIG. 1A, "OFF" means the backlight is cut off or its brightness is decreased below a certain specified value, while "ON" means the brightness of the backlight is increased above a certain specified value by its drive circuit. FIG. 1B shows the control clock for driving the backlight module corresponding to the illumination brightness change of the backlight in FIG. 1A. FIG. 1C shows the periodic change of presence (Y) and absence (N) of the scan signal of the liquid crystal panel. As can be known from the figures, the backlight illumination frequency is controlled to correspond to the scan frequency of the liquid crystal panel in the prior art so as to accomplish a better display quality.

U.S. Pat. No. 6,693,619 disclosed a liquid crystal display apparatus comprising a liquid crystal module, a backlight module, and a control circuit for controlling backlight illumination. The control circuit controls the backlight illumination frequency to be in synchronism with the synchronization signal of the liquid crystal panel. When the liquid crystal module scans an image, the relevant backlight is cut off until the scanning is finished. The liquid crystal module can therefore successfully display the image, hence solving the hold-type effect of image display.

FIGS. 2A to 2D show frame images of the prior art. In FIG. 2A, the nth frame is displayed on a liquid crystal module 20. As shown in FIG. 2B, when the (n+1)th frame is to be displayed on the liquid crystal module 20, the upper half image is scanned, and the above control circuit for controlling backlight illumination turns off the backlight for illuminating the upper half panel while keeping the backlight for illuminating the lower half panel. Next, as shown in FIG. 2C, the lower half image is scanned, and the above control circuit for controlling backlight illumination turns off the backlight for illuminating the lower half panel while turning on the backlight for illuminating the upper half panel. The scan step of the image is thus finished. Afterward the whole image of the (n+1)th frame is displayed, as shown in FIG. 2D.

When there are a large quantity of dynamic frames (e.g., when watching a movie or TV program), the hold-type effect will occur in the liquid crystal display apparatus because of slower response of liquid crystal. Moreover, the backlight illumination frequency is not synchronous with the scan signal or the data write signal. In the above two disclosures, a control circuit is used to control the backlight illumination frequency to be in synchronism with the scan cycle or controlling the on/off state of the backlight light to solve the hold type problem. The present invention proposes a liquid crystal backlight device to solve the hold type problem due to the hold-type effect of liquid crystal occurred in the prior art.

SUMMARY OF THE INVENTION

An object of the present invention is to provide a liquid crystal backlight device and a method for controlling the same, which are applied to a liquid crystal display apparatus to solve the hold type problem due to the hold-type effect of liquid crystal. The display apparatus controls its backlight illumination pattern to produce differences in the illumination frequency, illumination intensity, or pulse width of an illumination signal when switching frames, therefore improving the hold type and flickering phenomena through the generated stable illumination backlight. The liquid crystal backlight device comprises a display signal output unit for receiving a display signal sent from an external device, a stable-time calculation unit coupled with the display signal output unit and used to obtain a stable display time according to display signals received by the display signal output unit, a signal processing unit coupled with the stable-time calculation unit and used to produce a pulse-width modulated signal, a backlight module control unit for receiving the pulse-width modulated signal to produce a backlight activation signal, a backlight module coupled with the backlight module control unit and used for backlight illumination of a liquid crystal module, a display controlling unit coupled with the display signal output unit and used to generate display data and a scan signal, a scan drive unit coupled with the liquid crystal module, and a data drive unit coupled with the liquid crystal module.

According to a preferred embodiment of the present invention, an illumination method of the liquid crystal backlight device comprises the steps of: using a display signal output unit to receive a display signal sent from an external device; transmitting the display signal to a stable-time calculation unit; using the stable-time calculation unit to obtain a stable display time according to messages in the display signal; transmitting the stable display time to a signal processing unit; performing modulation to a backlight illumination signal (including using a time delay control unit to perform delay control of a backlight activation time, using a duty cycle control unit to adjust the duty cycle of backlight illumination, and so on); generating a pulse-width modulated signal and a brightness modulated signal based on the time delay and duty cycle of backlight activation; generating a modulated backlight activation signal; and controlling a backlight illumination pattern of the backlight module.

In order to achieve stable illumination of liquid crystal, the illumination method of the backlight module further comprises the steps of: transmitting the display signal received by the display signal output unit to a display controlling unit; using the display controlling unit to obtain display data and a scan signal; using a data drive unit to receive the display data; using a scan drive unit to receive the scan signal; generating a frame scan timing for controlling the liquid crystal module and synchronously processing the above backlight activation timing, display data, and scan timing; and finally displaying a frame.

The above backlight device is used to drive a liquid crystal display apparatus. Before liquid crystal achieves stable display, pulse-width modulation and brightness adjustment are performed to the backlight module (e.g., using a time delay control unit disposed in the signal processing unit to perform delay control of a backlight activation time and using a duty cycle control unit disposed in the signal processing unit to adjust the duty cycle of backlight illumination). Next, the signal processing unit generates a pulse-width modulated signal or a brightness modulated signal. The backlight module control unit then receives the pulse-width modulated signal or the brightness modulated signal. Subsequently, the backlight module control unit generates a modulated backlight activation signal. Finally, the display apparatus controls its backlight illumination pattern to produce differences in the illumination frequency, illumination intensity, or pulse width of an illumination signal when switching frames or various banks of the same frame so as to improve the hold type and flickering phenomena through the generated stable illumination backlight.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Instead of driving the backlight illumination frequency to correspond to the signal write cycle of the liquid crystal panel, the present invention makes use of a stable illumination backlight module modulated by the illumination frequency, the illumination intensity, or the illumination signal to immediately activate backlight illumination after the display of pixels is stable so as to improve the display quality.

Figure 1A:
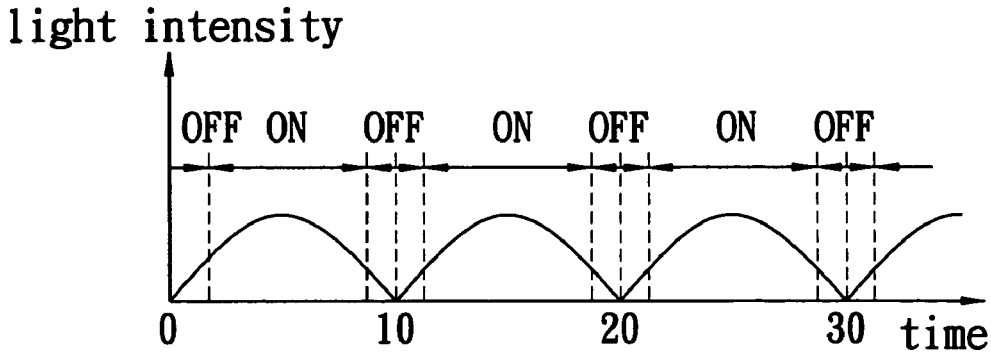
FIG. 1A PRIOR ART
FIGS. 1A to 1C are clock diagrams showing the relationship between the backlight illumination frequency and the scan signal of a liquid crystal panel in the prior art.
Figure 1B:
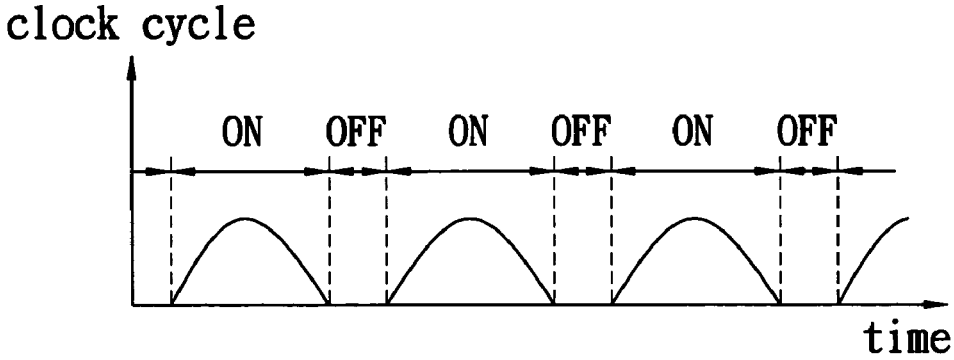
FIG. 1B PRIOR ART
Figure 1C:
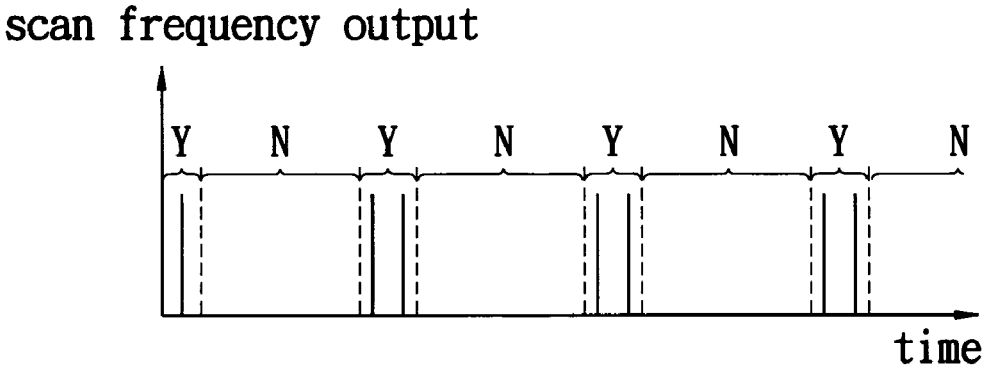
FIG. 1C PRIOR ART
Figures 2A, 2B, 2C, 2D:
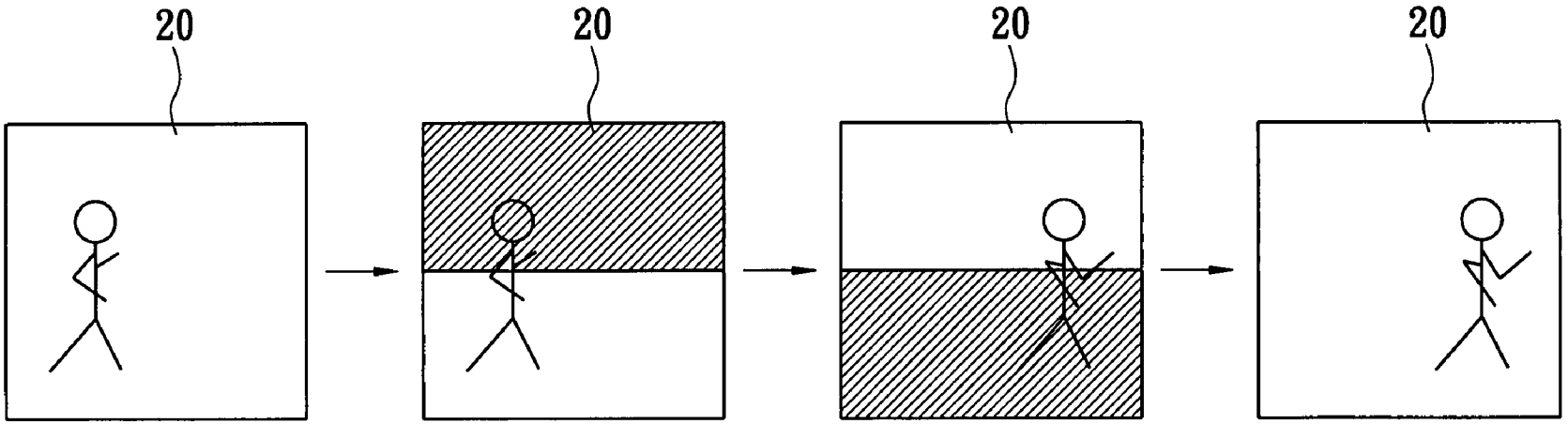
FIG. 2A PRIOR ART
FIG. 2B PRIOR ART
FIG. 2C PRIOR ART
FIG. 2D PRIOR ART
FIGS. 2A to 2D show frame images of the prior art.
Figure 3A:
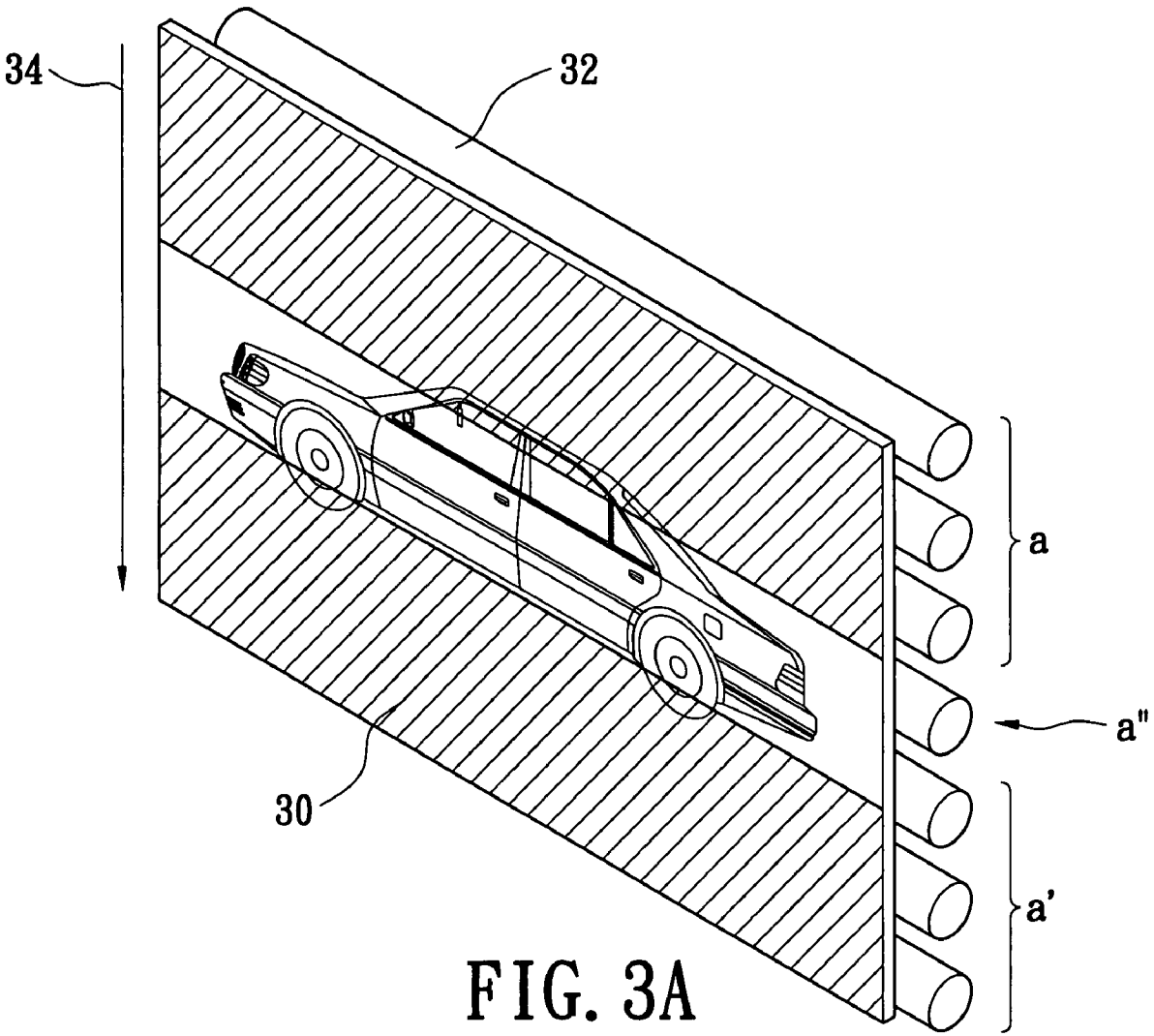
FIG. 3A PRIOR ART
FIG. 3A is a diagram of a liquid crystal display apparatus of the prior art.

FIG. 3A shows a liquid crystal display apparatus comprising a liquid crystal panel 30 and a backlight module 32 having a plurality of lamp tubes. When the scan signal is input to the liquid crystal display apparatus, the on/off operations of the backlight module 32 are performed according to the scan signal and the scan direction 34 (shown as the arrow in the figure) of pixels. The figure shows the frame at a certain instant. When the scan signal passes the center of the frame, the lamp tube a is turned on, while other lamp tubes such as a and a are off.

Figure 3B:
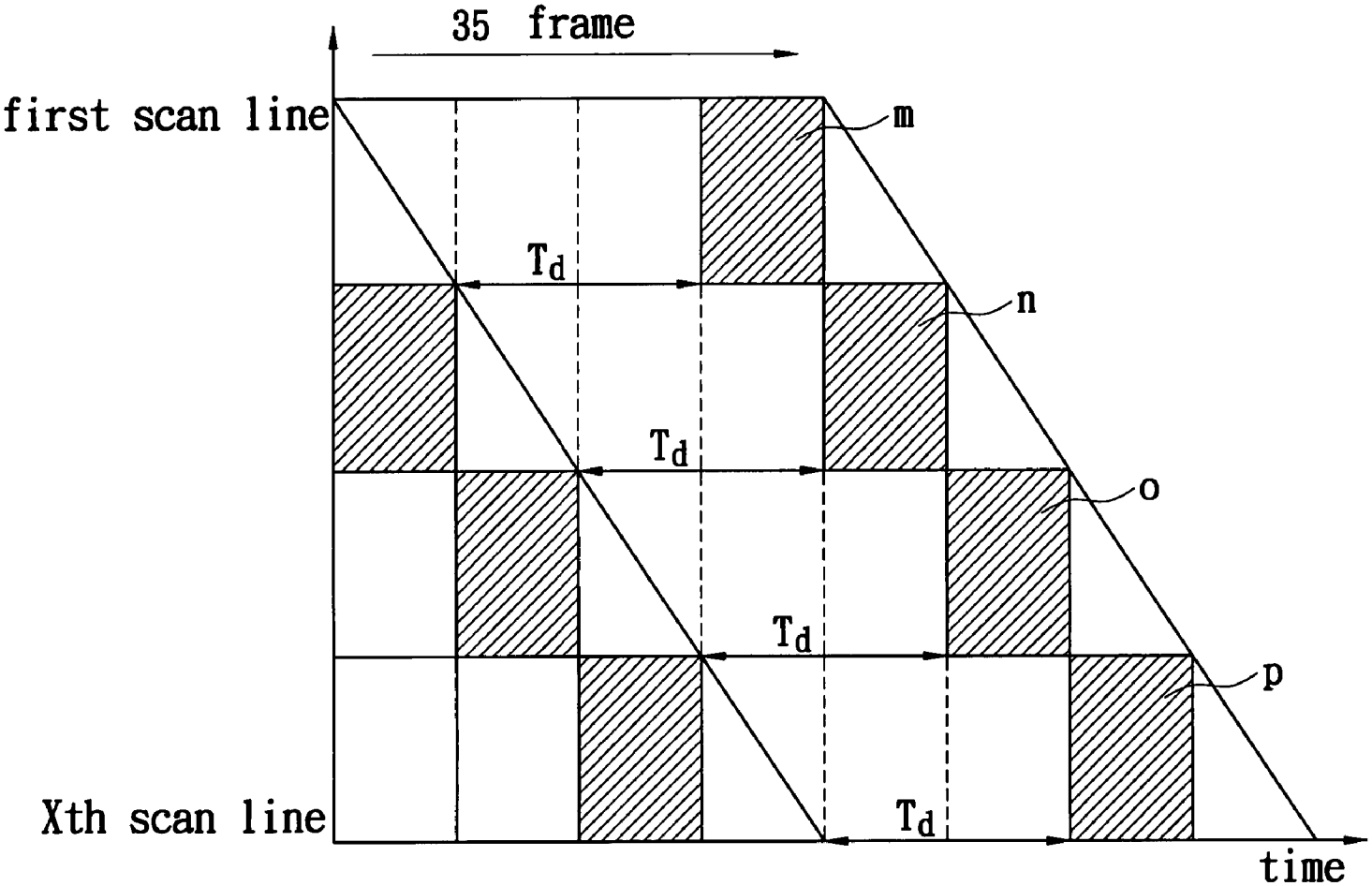
FIG. 3B PRIOR ART
FIG. 3B is a diagram showing the relationship between the scan signal and time of a liquid crystal display apparatus of the prior art.

FIG. 3B is a diagram showing the relationship between the scan signal and time of a liquid crystal display apparatus of the prior art, in which the y-axis represents the scan line (scan line 1 to scan line X) and the x-axis represents time. The scan line goes from scan line 1 to scan line X. In this figure, the frame is partitioned into a plurality of banks, as banks m, n, o, and p shown in the same frame (frame 35). That is, a bank is scanned at a time. After time Td, banks of the next frame are generated. The time $T_d$ is generally the longest time for stable display of pixels. When scanning a bank, the corresponding backlight is activated accordingly. For example, in the frame 35, the bank m is scanned at first time, the bank n is scanned at second time, the bank o is scanned at third time, and the bank p is scanned at fourth time. Generally speaking, each bank (m, n, o, or p) has the same number of scan lines, e.g., each bank (m, n, o, or p) has X/4 scan lines if the total number of scan lines in a frame is X.

Figure 3C:
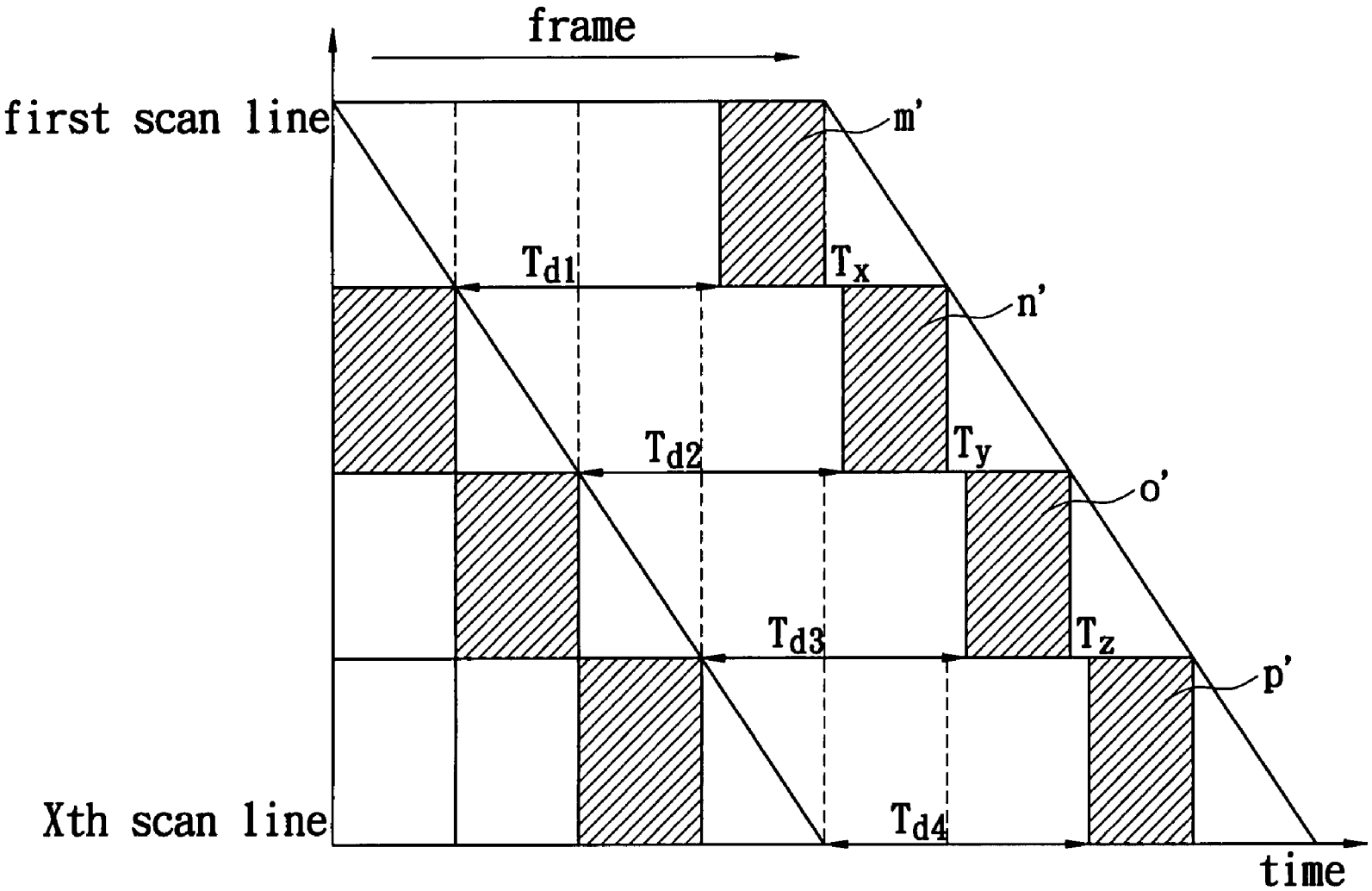
FIG. 3C is a diagram showing the relationship between the scan signal and time of a liquid crystal display apparatus of the present invention.

FIG. 3C is a diagram showing the relationship between the scan signal and time of a liquid crystal display apparatus of the present invention, in which the display pattern of a frame at a certain instant after modulated by the method for controlling a backlight module of the present invention is displayed. The frame has a first time scan bank m, a second time scan bank n, a third time scan bank o, and a fourth time scan bank p. According to an embodiment, the method has the following characteristics:

1. The number of scan lines of each bank in the same frame can be different through modulation of the scan frequency. It is not necessary to evenly distribute the scan in different banks. The banks m, n, o, and p thus can have different number of scan lines.
2. When going from the previous frame to the present frame, the time differences of the scanned banks between the two frames can be different, i.e., $T_{d1}$, $T_{d2}$, $T_{d3}$, and $T_{d4}$ can be different. Because the backlight is turned on/off according to the scan lines of each bank, stable illumination of liquid crystal after modulation can be accomplished by means of this characteristic.
3. In the same frame, the start time of each scanned bank (m, n, o, or p) can be different, i.e., the delay time of each scanned bank can be controlled to be different.
4. Besides, when scanning the same frame, the scan timing between each scanned bank needs not to be continuous, and a time gap (e.g., $T_x$, $T_y$, $T_z$) can be generated between them, and the time gaps can also be different.

The present invention utilizes the slight time differences generated between each frame, each scanned bank, and each scan timing to solve the problem of unstable frame display of pixels of a display apparatus.

Figure 4A:
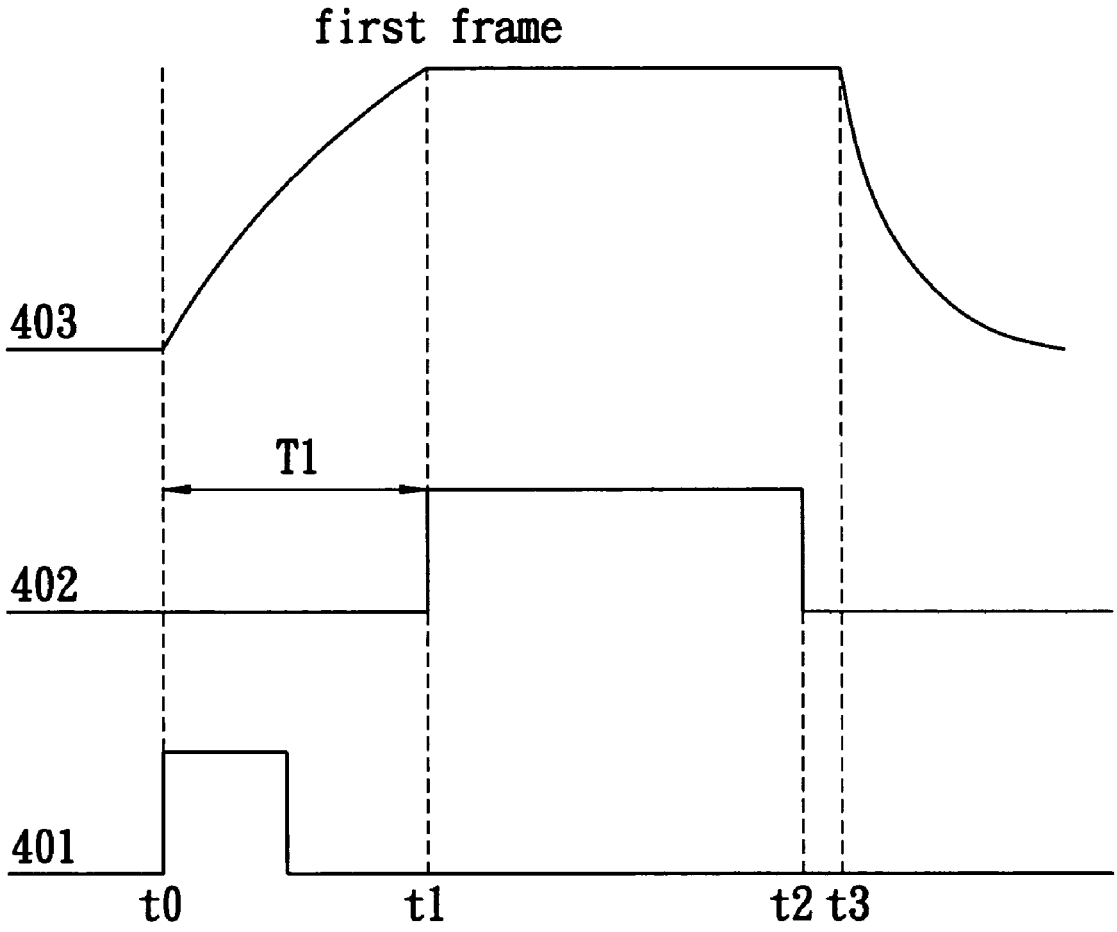
FIGS. 4A to 4B are diagrams showing the relationship between the timings of activation of the backlight module and display of pixels of the present invention.
Figure 4B:
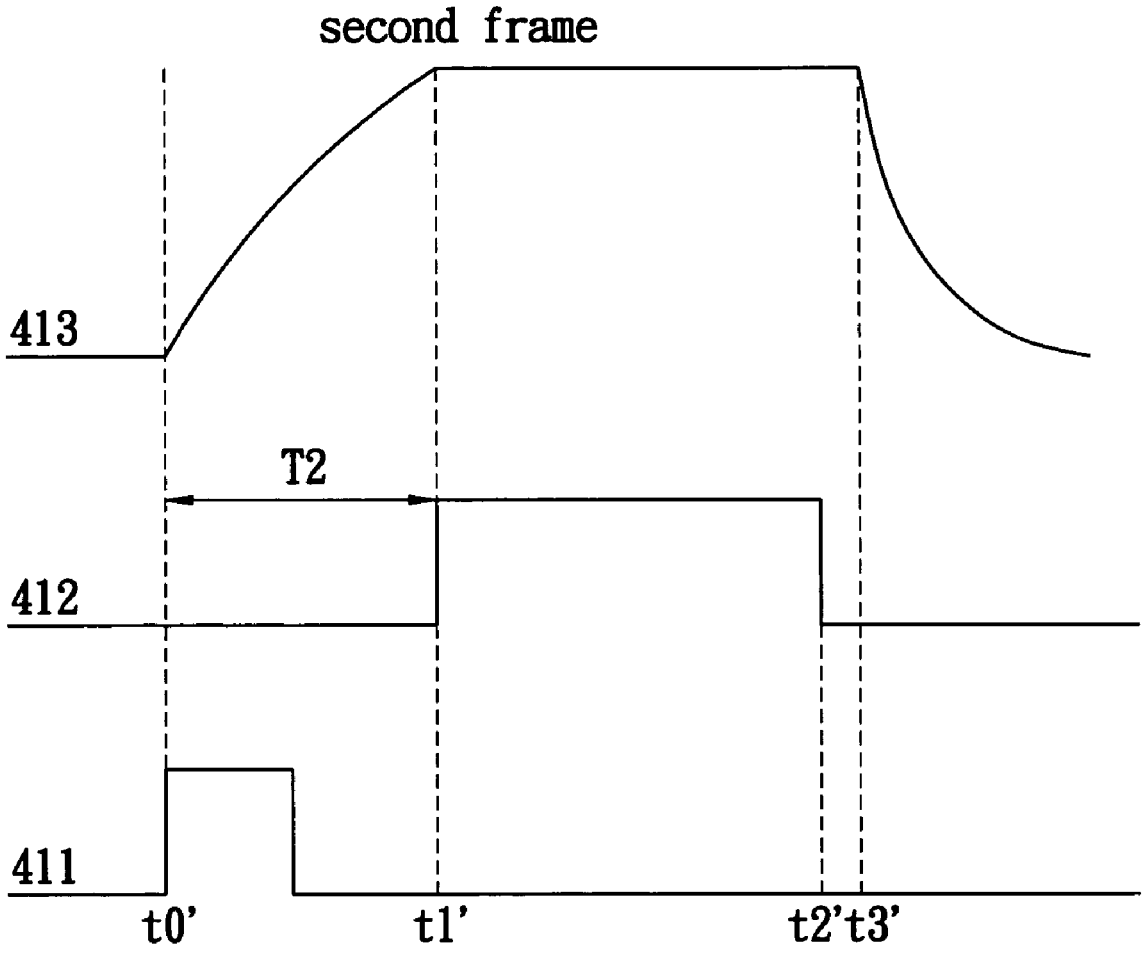

FIGS. 4A to 4B show the relationship between the timings of backlight module activation and liquid crystal display of two consecutive frames according to an embodiment of the present invention, respectively. FIG. 4A shows the first frame (frame 1), and FIG. 4B shows the next frame (frame 2).

FIG. 4A shows the activation timings of a pixel and a backlight module when displaying a frame according to a preferred embodiment of the present invention. A pixel is driven for displaying (as shown by the display signal 403) by a scan signal 401 (the square wave shown in the figure). When the scan signal 401 starts at time $t_0$, the pixel is activated, and its intensity gradually increases to a steady state until time $t_1$, as shown by the horizontal part of the display signal 403. At time $t_1$, the backlight module is also activated, as shown by the backlight activation signal 402 in the figure. When the display intensity reaches the steady state, the backlight is simultaneously activated for illumination. A first time T1 represents the time difference from the time when the liquid crystal is activated ($t_0$) to the time when the intensity of the pixel reaches the steady state ($t_1$). Finally, before displaying the next frame, the backlight is turned off at time $t_2$, and the intensity of the pixel decreases to the off state at time $t_3$.

FIG. 4B shows the activation timings of a pixel and a backlight module when displaying the next frame according to the preferred embodiment of the present invention. The bank can be the same as that in FIG. 4A. At time $t_0$ the scan line 411 drives the pixel for displaying (as shown by the display signal 413 with a gradually increasing intensity in the figure). The pixel is activated at time $t_0$, and its intensity gradually increases to a steady state until time $t_1$. At time $t_1$, the backlight module is also activated, as shown by the backlight activation signal 412 in the figure. When the pixel starts displaying, its intensity reaches the steady state after a second time T2, and the backlight is simultaneously activated for illumination. Afterwards, before displaying the next frame, the backlight is turned off at time $t_2$, and the intensity of the pixel decreases to the off state at time $t_3$.

When the backlight module of the above liquid crystal display apparatus receives the scan signal and the whole image is switched between different frames, because the backlight module is activated and turned off within the same period, the same illumination frequency will cause a flickering problem. In consideration of this problem, the present invention adjusts the activation time of the backlight module so that when switching frames, slight time differences will be generated between the activation times of the backlight module in the same bank. In other words, the first time T1 in FIG. 4A is not equal to the second time T2 in FIG. 4B, and the on/off time of the backlight module is not in synchronism with the on/off time of display. Therefore, when fast switching activation of backlight, the problem of unstable and flickering frames can be avoided.

Figure 5A:
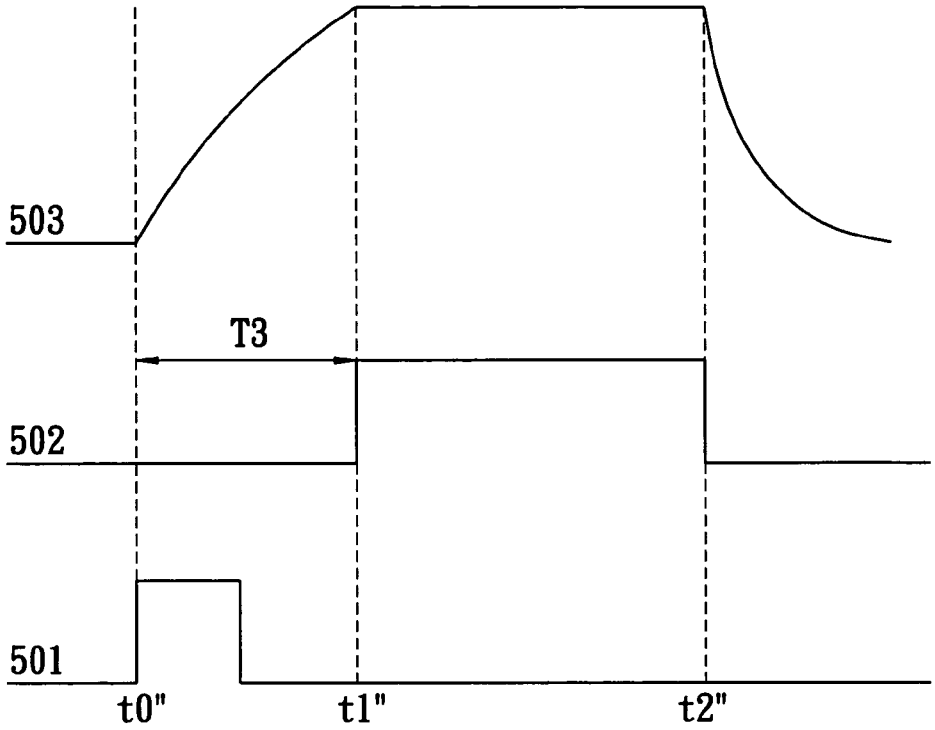
FIGS. 5A to 5B are diagrams showing the relationship between the timings of activation of the backlight module and display of pixels of the present invention.
Figure 5B:
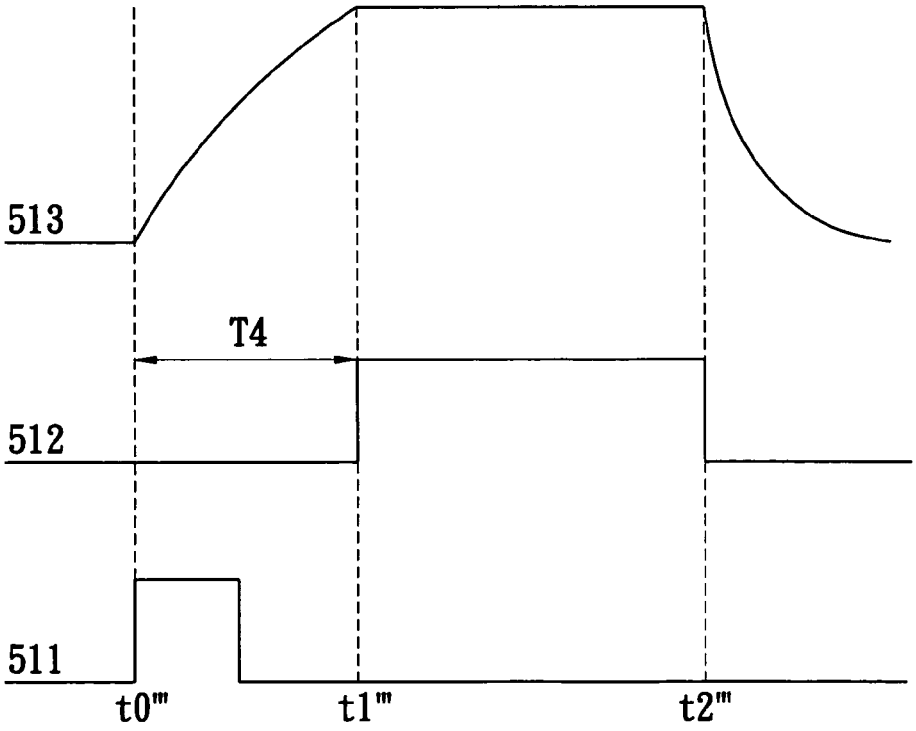

FIGS. 5A to 5B show the relationship between the timings of activation of the backlight module and display of pixels of two consecutive banks in the same frame according to an embodiment of the present invention, respectively.

FIG. 5A shows the activation timings of a pixel and a backlight module when displaying a frame according to a preferred embodiment of the present invention. A pixel is driven for displaying (as shown by the display signal 503) by a scan signal 501. When the scan signal 501 starts at time, the pixel is activated for displaying, and the backlight module is activated after third time T3. When the scan signal 501 starts at time $t_0$, the pixel is activated, and its intensity gradually increases to a steady state until time $t_1$, as the horizontal part of the display signal 503. At time $t_1$, the backlight module is also activated, as shown by the backlight activation signal 502 in the figure. When the display intensity reaches the steady state, the backlight is simultaneously activated for illumination. The third time T3 represents the time difference from the time when the liquid crystal is activated ($t_0$) to the time when the liquid crystal reaches the steady state ($t_1$). Finally, before displaying the next frame, the backlight is turned off at time $t_2$, and the intensity of the pixel decreases to the off state at time $t_3$.

FIG. 5B shows the activation timings of a pixel and a backlight module when displaying the next bank in the same frame according to the preferred embodiment of the present invention. At time $t_0$ the scan line 511 drives the pixel for displaying (as shown by the display signal 513 with a gradually increasing intensity in the figure). The pixel is activated at time $t_0$, and its intensity gradually increases to a steady state until time $t_1$. At time $t_1$ (i.e., after fourth time T4 from the time when the scan signal 511 starts), the backlight module is also activated, as shown by the backlight activation signal 512 in the figure, and the pixel reaches the steady state at the time. Afterwards, before displaying the next frame, the backlight is turned off at time $t_2$, and the intensity of the pixel decreases to the off state at time $t_3$.

When the backlight module of the above liquid crystal display apparatus receives the scan signal, the backlight module activation times of different banks in the same frame are the same. That is, the third time T3 in FIG. 5A is equal to the fourth time T4 in FIG. 5B. Because the backlight module is turned on and off within the same time, the same illumination frequency will cause a flickering problem. In the present invention, however, the backlight module activation times when switching frames are adjusted to be slightly different, e.g., the first time T1 in FIG. 4A is made slightly different from the second time T2 in FIG. 4B to obtain the backlight module of stable illumination so as to give a stable display effect in vision.

Figure 6:
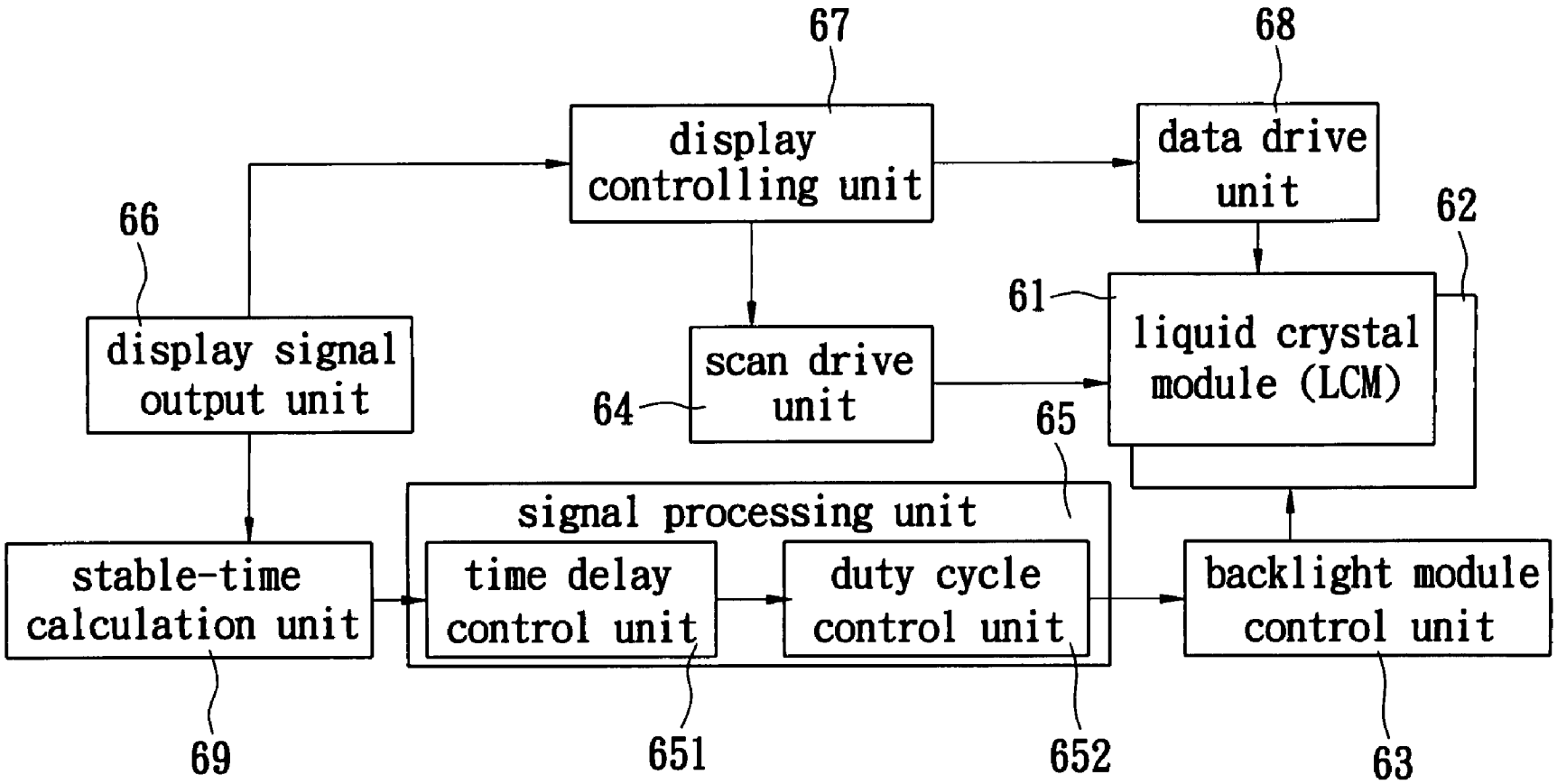
FIG. 6 is a block diagram of a liquid crystal backlight device of the present invention.

FIG. 6 is a block diagram of a liquid crystal backlight device according to a preferred embodiment of the present invention. The liquid crystal backlight device comprises a liquid crystal module 61, a backlight module for backlight illumination of the liquid crystal module 61, a backlight module control unit 63 for controlling the illumination pattern of the backlight module 62, a signal processing unit 65 coupled with the backlight module control unit 63, a scan drive unit 64 coupled with the liquid crystal module 61, a data drive unit 68 coupled with the liquid crystal module 61, a display controlling unit 67 coupled with the scan drive unit 64, a stable-time calculation unit 69 coupled with the signal processing unit 65, and a display signal output unit 66 coupled with the display controlling unit 67 and the stable-time calculation unit 69. The signal processing unit 65 further comprises a time delay control unit 651 and a duty cycle control unit 652.

The display signal output unit 66 receives a display signal sent from an external device, and sends the display signal to the display controlling unit 67 and the stable-time calculation unit 69. The stable-time calculation unit 69 obtains a stable display time according to messages in the display signal. The signal processing unit 65 processes the stable display time to generate a pulse-width modulated signal, which is used to generate a backlight activation signal for display. The time delay control unit 651 and the duty cycle control unit 652 of the signal processing unit 65 are used to provide a signal for controlling backlight illumination for the backlight module control unit 63.

The backlight module control unit 63 can be an inverter, and is used to provide power for the backlight module 62. The display controlling unit 67 can be an analog-to-digital converter (A/D converter), and is used to drive the liquid crystal module 61 to be on/off or to switch frames.

The display signal is sent to the display controlling unit 67 to generate a scan signal and data to be displayed. The scan signal at least includes a message of liquid crystal activation time, and the display frame and the scan pattern are determined based on the data. The backlight module 62 in the liquid crystal display apparatus changes the illumination period or frequency according to the above pulse-width modulated signal matched with the display. According to a preferred embodiment, the time delay control unit 651 in the signal processing unit 65 adjusts the activation time of the backlight module 62 according to the signal output by the display signal output unit 66, e.g., adjusts a specific time difference between two consecutive frames. Through adjusting the activation time and the backlight illumination pattern (e.g., illumination frequency, illumination intensity, pulse width of the illumination signal, and so on) of the backlight module 62, the fast and stable illumination backlight can effectively solve the problems of hold-type effect and flickering frame in a fast-scan display state.

Moreover, an amplification circuit in the backlight module control unit 63 can be used to adjust the illumination brightness of backlight to generate slight difference of brightness between each pixel, thereby solving the problem of flickering frame in the prior art.

Figure 7:
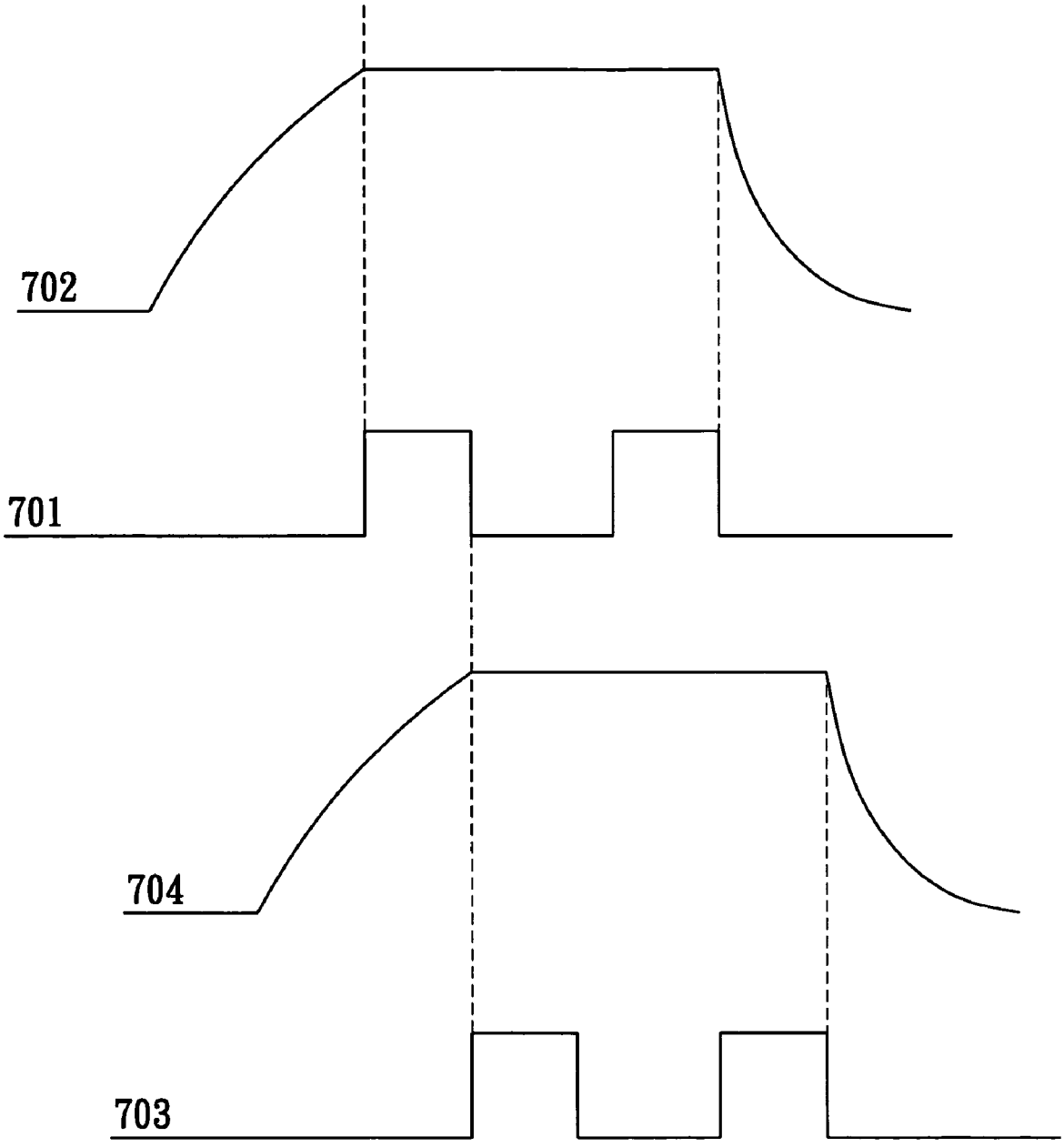
FIG. 7 is a timing diagram of adjusting the backlight module illumination frequency according to an embodiment of the present invention.

FIG. 7 is a timing diagram of adjusting the backlight module illumination frequency according to an embodiment of the present invention. In the present invention, the number of scan lines of the banks in the same frame can be different, and it is not necessary to evenly distribute the scan lines in different banks. As shown in FIG. 7, when the scan line (not shown) is input, the pixels start displaying, as shown by a display signal 702 in the figure. When the display signal 702 reaches a steady state, a backlight activation signal 701 is driven. After processed by the signal processing unit 65, a frequency signal and a pulse-width modulated signal are generated to have the backlight activation signal 701 with a higher frequency for displaying. For instance, the backlight activation signal 701 in the figure has twice the illumination frequency. The above modulation can be realized with a pulse-width modulation (PWM) circuit. Similarly, the backlight module of another bank in the same frame also illuminates the corresponding pixels with a higher frequency. As shown in the figure, the backlight activation signal 703 of twice the illumination frequency performs on/off of illumination with the display signal 704. It should be noted that the backlight activation signals 701 and 703 of the above two banks can overlap each other or not. This embodiment makes use of a higher illumination frequency to improve the problem of unstable or flickering frame.

Figure 8:
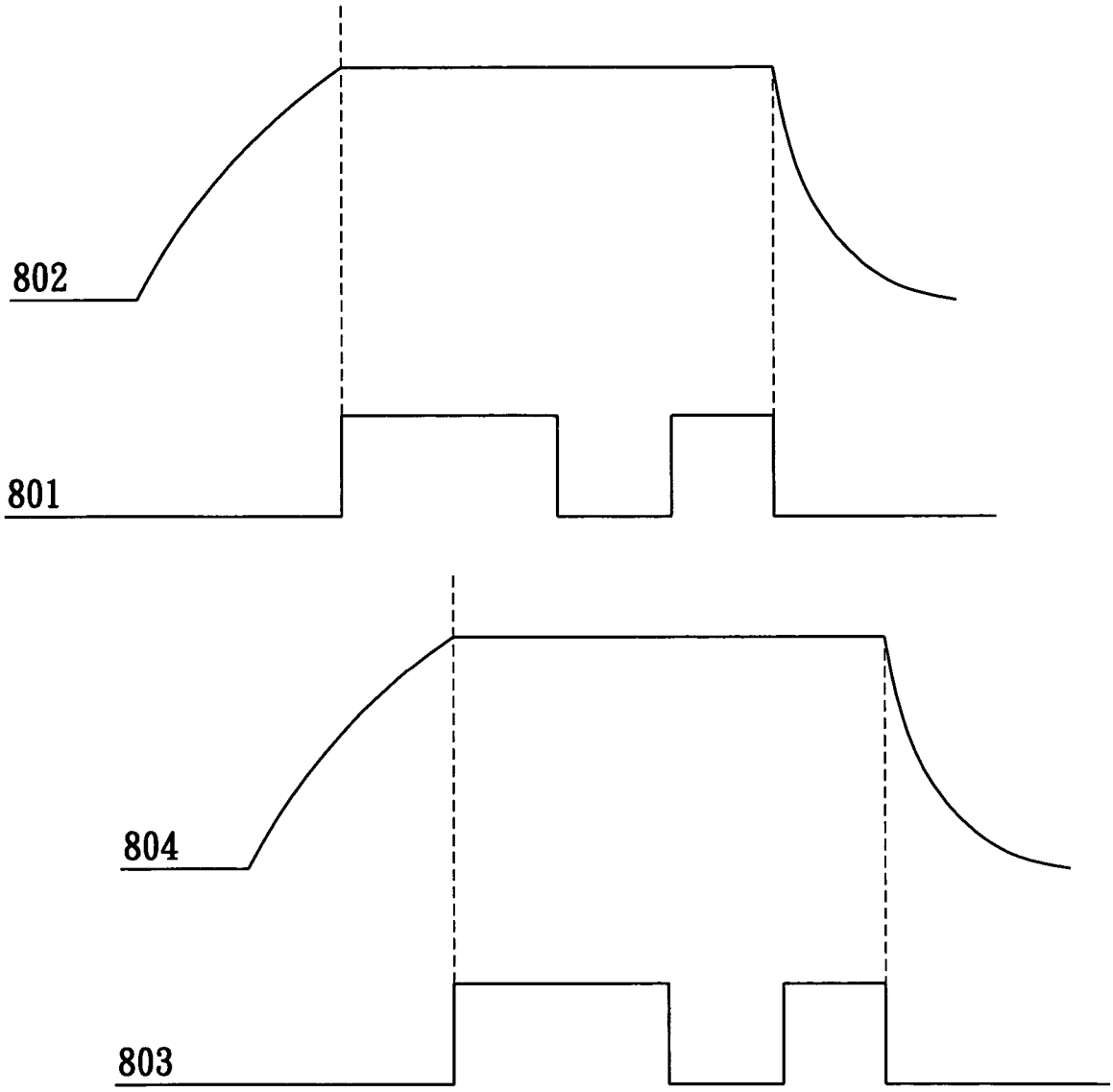
FIG. 8 is a timing diagram of adjusting the backlight module illumination frequency according to another embodiment of the present invention.

FIG. 8 is a timing diagram of adjusting the backlight module illumination frequency according to another embodiment of the present invention. The signal processing unit 65 generates a pulse-width modulated signal and outputs the pulse-width modulated signal to the backlight module control unit 63 to adjust the pulse width of the backlight activation signal. As shown in FIG. 8, after the display signal 802 of a bank is activated and reaches a steady state, the backlight activation signal 801 is activated and is adjusted to have different pulse widths. The backlight activation signal 803 of another bank in the same frame is also adjusted to have different pulse widths. The backlight module 62 can therefore have a higher illumination frequency to improve the problem of unstable and flickering frame.

Figure 9A:
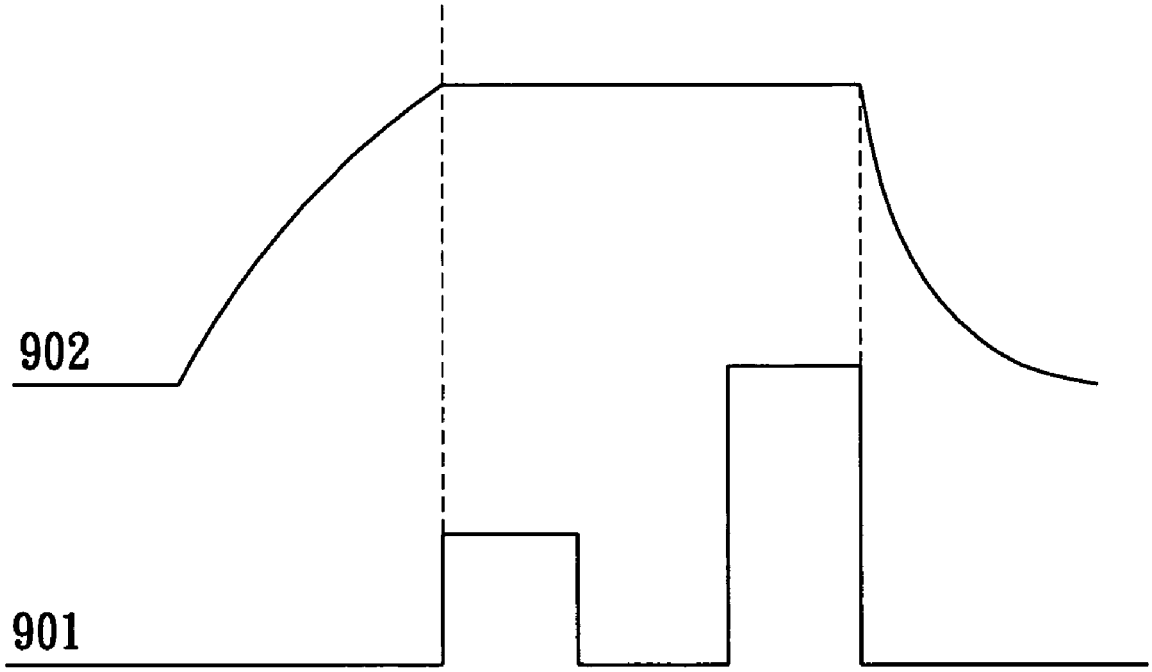
FIGS. 9A to 9C are timing diagrams of adjusting the backlight module illumination frequency according to an embodiment of the present invention.
Figure 9B:
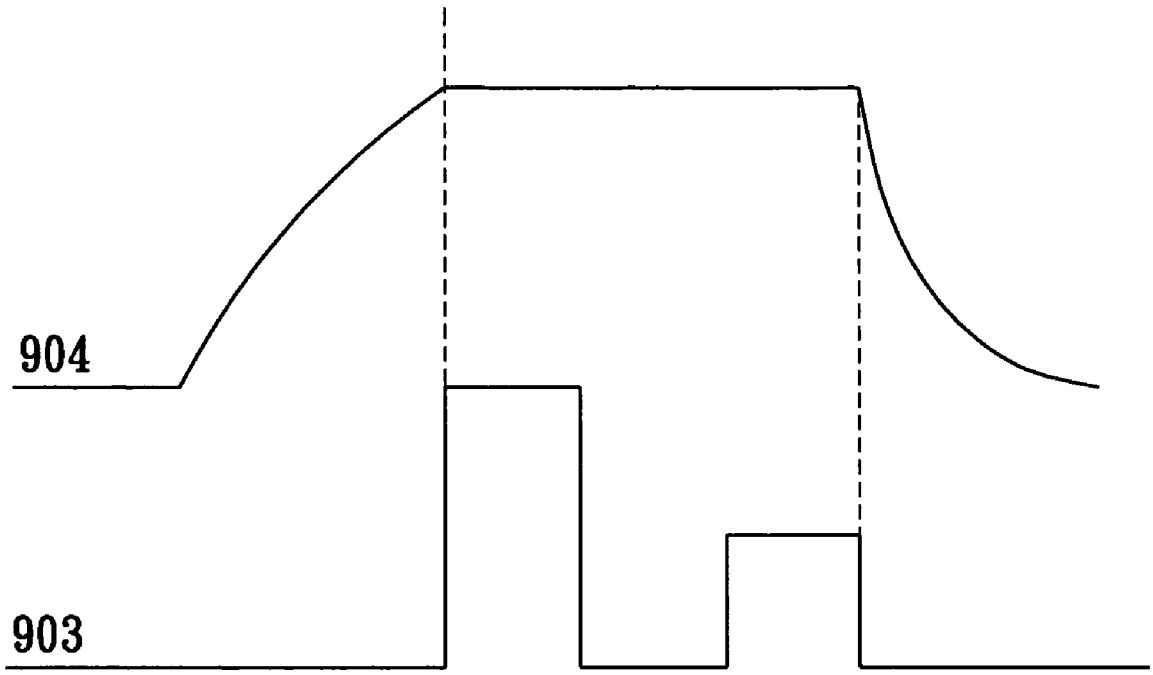

The signal processing unit 65 in the liquid crystal display apparatus of the present invention is used to generate a backlight illumination pattern (e.g., illumination frequency, illumination intensity, pulse width of illumination signal, and so on) to change the frequency, magnitude, and pulse width of the backlight activation signal of each pixel so as to produce differences in the timing and intensity of display, hence improving the display quality. FIG. 9A utilizes a backlight activation signal of different illumination intensities to control the backlight module to generate another stable illumination pattern when switching frames, thereby solving the problem of unstable and flickering frames. For example, the backlight activation signal 901 has different magnitudes in the same period of the display signal 902. In FIG. 9B, the backlight activation signal 903 has another kind of different magnitudes in the same period of the display signal 904.

Figure 9C:
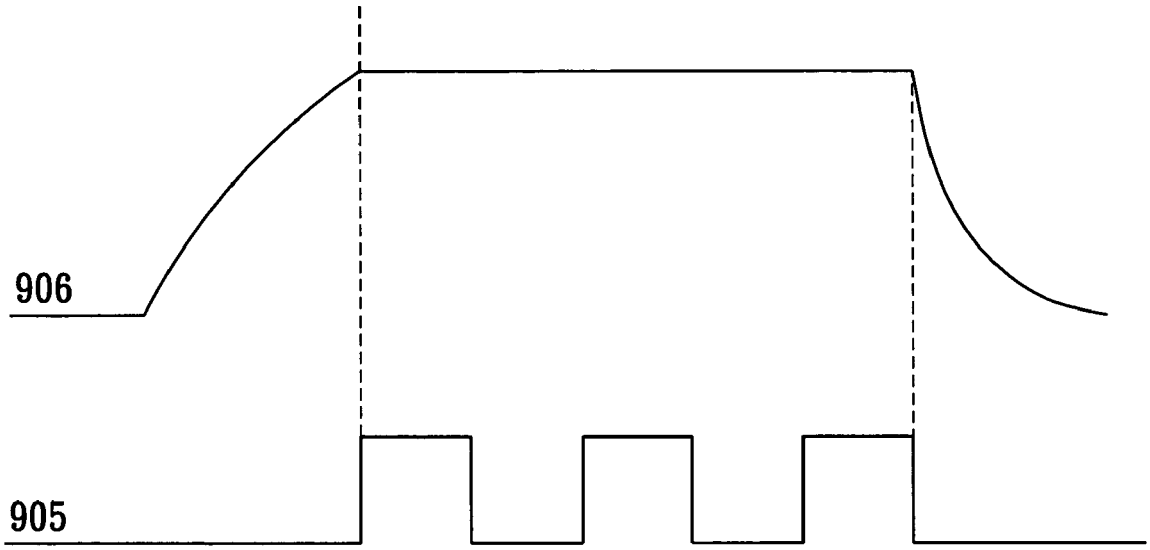

In FIG. 9C, the backlight activation signal 905 has triple the illumination frequency. Stable frames can thus be accomplished by means of higher illumination frequency under the liquid crystal display signal 906 in a frame and also through visual judgement.

The backlight device of the present invention uses the signal processing unit 65 to receive an image display signal. If the received display signal is a static frame, the backlight module control unit 63 will adjust out a faster illumination frequency. Matched with the differences of the backlight module activation time of each pixel controlled by the backlight activation signal, stable frames can be displayed. If the received display signal is a dynamic frame, the illumination frequency adjusts out different illumination frequencies and backlight brightness according to different action patterns to display stable frames.

Figure 10:
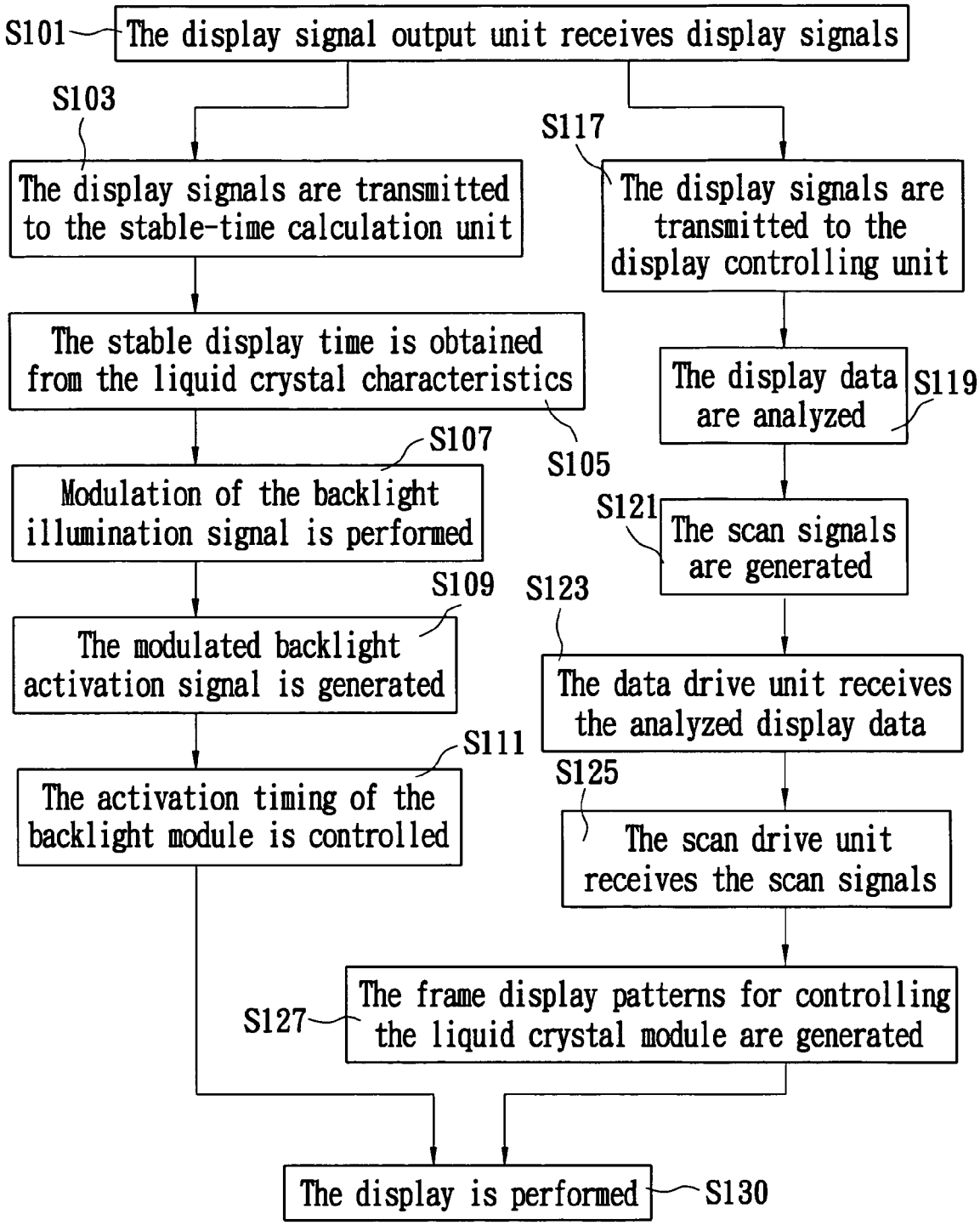
FIG. 10 is a flowchart of an illumination method of a liquid crystal backlight device of the present invention.

FIG. 10 is a flowchart of an illumination method of a liquid crystal backlight device of the present invention. The method accomplishes the effect of stable illumination backlight by means of the display apparatus shown in FIG. 6.

First, the display signal output unit 66 in the display apparatus receives a display signal sent from an external device, e.g., a display signal sent from a VGA card (Step S101). This display signal is processed and then transmitted to the stable-time calculation unit 69 to control the backlight activation timing (Step S103). The display signal is also transmitted to the display controlling unit 67 to control display (Step S117).

The backlight control procedure comprises the following steps: The stable-time calculation unit 69 is used to obtain information such as the stable display time from the characteristics of liquid crystal used (Step S105). The information obtained from the characteristics of liquid crystal such as the stable display time is then transmitted to the signal processing unit 65 for modulation of the backlight illumination signal (Step S107). Because the response time of liquid crystal is slow, the time delay control unit 651 can be used to perform delay control of the backlight activation time is performed before liquid crystal reaches the steady state. The duty cycle can then be adjusted by using the duty cycle control unit 652. The adjustment of duty cycle is aimed at the working frequency of the backlight activation signal to change the backlight illumination pattern such as illumination frequency, illumination intensity, pulse width of the illumination signal, and so on. Based on the information such as time delay and duty cycle of the backlight activation signal, the modulation signal of pulse width, illumination frequency, or illumination intensity is generated to produce the modulated backlight activation signal (Step S109). After the above steps, the activation time of the backlight module can be determined. The backlight activation signal is used to control the activation timing of the backlight module of the display apparatus (Step S111).

The display procedure comprises the following steps. The display signal received from the external device is transmitted to the display controlling unit 67 (Step S117). The display controlling unit 67 analyzes the display signal to get display data (Step S119). A scan signal is also generated according to the display signal (Step S121). The scan signal is produced according to the display state such as a static or a dynamic frame. The data drive unit then receives the analyzed display data and generates frame data to be displayed on the liquid crystal module 61 (Step S123). The scan signal is received by the scan drive unit 64 to generate the display scan signal of the liquid crystal module 61 (Step S125). The frame display patterns for controlling the liquid crystal module are generated (Step S127).

Finally, the backlight module 62 receives the above backlight activation timing, and the liquid crystal module 61 receives the data to be displayed and the scan timing. After synchronous processing of the backlight activation timing, the display data, and the scan timing, the display patterns of the liquid crystal display apparatus and the backlight illumination patterns of the backlight module 62 can be controlled to display frames on the liquid crystal module 61 and generate stable backlight illumination, thereby improving the hold type and flickering phenomena (Step S130).

After the flowchart in FIG. 10, difference is generated between the backlight activation time of pixels. Moreover, the brightness, pulse width, and frequency of different backlight activation signals can also be adjusted to solve the hold type and flickering problems occurred in conventional display apparatus.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

What is claimed is:

1. A control method of a liquid crystal backlight device, said control method comprising the steps of:

obtaining a stable display time from the intrinsic delay characteristic of the liquid crystal;

transmitting the obtained stable display time to a signal processing unit for modulation of a backlight illumination signal;

modulating the backlight illumination signal, including adjusting a backlight illumination frequency, a backlight illumination intensity and a pulse width of the backlight illumination signal, by performing delay control using a plurality of backlight activation times of the liquid crystal, wherein the backlight illumination signal has two different amplitudes in a frame time;

performing delay control of the backlight activation times until the liquid crystal reaches a steady state;

generating a modulated backlight activation signal by a modulation signal regarding the pulse width of the backlight illumination signal, the backlight illumination frequency, or the backlight illumination intensity according to information of a duty cycle of a backlight activation signal of a backlight module; and controlling a backlight activation timing;

wherein the backlight activation timing of the backlight module is controlled to change its backlight illumination pattern including the backlight illumination frequency, the backlight illumination intensity and the pulse width of the backlight illumination signal by adjusting the duty cycle of the backlight activation signal in order to achieve stable backlight illumination.

2. The control method as claimed in claim 1, wherein said step of modulating the backlight illumination signal further comprises a step of adjusting a duty cycle of backlight illumination.

3. The control method as claimed in claim 1, wherein said step of modulating the backlight illumination signal further comprises a step of performing pulse-width modulation of backlight illumination.

4. A display apparatus using the control method as claimed in claim 1, comprising:

a display signal output unit for receiving a display signal sent from an external device;

a stable-time calculation unit coupled with said display signal output unit and used to obtain a stable display time according to said display signal received by said display signal output unit;

a backlight module control unit for receiving said pulse-width modulated signals to produce a plurality of backlight activation signals;

a backlight module coupled with said backlight module control unit and used for backlight illumination of a liquid crystal module;

a display controlling unit coupled with said display signal output unit and used to generate display data and a scan signal;

a scan drive unit coupled with said liquid crystal module; and a data drive unit coupled with said liquid crystal module;

wherein the signal processing unit is coupled with said stable-time calculation unit and used to produce a plurality of pulse-width modulated signals based on delay characteristic of the liquid crystal.

5. The display apparatus having a liquid crystal backlight device as claimed in claim 4, wherein said signal processing unit further comprises a time delay control unit used to adjust an activation time of said backlight module according to a signal output by said display signal output unit.

6. The display apparatus having a liquid crystal backlight device as claimed in claim 4, wherein said signal processing unit further comprises a duty cycle control unit.

7. The display apparatus having a liquid crystal backlight device as claimed in claim 4, wherein said backlight module control unit is an inverter for providing power for said backlight module.

8. The display apparatus having a liquid crystal backlight device as claimed in claim 4, wherein said display controlling unit is an analog to digital converter.

9. The display apparatus having a liquid crystal backlight device as claimed in claim 4, wherein said backlight module control unit further comprises an amplification circuit for adjusting the backlight illumination intensity.

10. A control method of a liquid crystal backlight device, said control method comprising the steps of:

acquiring a stable display time from intrinsic delay characteristics of the liquid crystal;

performing a delay control using a plurality of backlight activation times intrinsically regarding the liquid crystal;

adjusting a duty cycle of backlight illumination;

performing pulse-width modulation of backlight illumination;

adjusting a backlight illumination frequency;

adjusting a backlight illumination intensity;

generating a modulated backlight activation signal by a modulation signal regarding pulse width of an illumination signal, illumination frequency, or illumination intensity according to information of a duty cycle of a backlight activation signal; and controlling a backlight illumination pattern including the illumination frequency, the illumination intensity, and the pulse width of the illumination signal by adjusting the duty cycle of the backlight activation signal of said backlight module, wherein the illumination signal has two different amplitudes in a frame time.

* * * * *